US010471500B2

(12) United States Patent
Tran et al.

(10) Patent No.: US 10,471,500 B2
(45) Date of Patent: Nov. 12, 2019

(54) STACK MOLDING PATTERN AND IMPROVED SHELL FOR MANUFACTURING AIRCRAFT TURBINE ENGINE BLADE ELEMENTS VIA LOST WAX CASTING

(71) Applicant: SAFRAN AIRCRAFT ENGINES, Paris (FR)

(72) Inventors: Roland Tran, Colombes (FR); Eric Eberschveiler, L'isle-Adam (FR); Anthony Le Fay, Jouy en Josas (FR); Patrick Pourfilet, Asnieres sur Seine (FR); Yvan Rappart, Montreuil (FR); Monique Tirel, Saint Denis (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 262 days.

(21) Appl. No.: 15/518,780

(22) PCT Filed: Oct. 12, 2015

(86) PCT No.: PCT/FR2015/052735
§ 371 (c)(1),
(2) Date: Apr. 13, 2017

(87) PCT Pub. No.: WO2016/059333
PCT Pub. Date: Apr. 21, 2016

(65) Prior Publication Data

US 2017/0239712 A1 Aug. 24, 2017

(30) Foreign Application Priority Data

Oct. 14, 2014 (FR) ..... 14 59834

(51) Int. Cl.
*B22C 7/02* (2006.01)
*B22C 9/04* (2006.01)
(Continued)

(52) U.S. Cl.
CPC ..... *B22C 9/20* (2013.01); *B22C 7/02* (2013.01); *B22C 9/04* (2013.01); *B22C 9/108* (2013.01);
(Continued)

(58) Field of Classification Search
CPC .... B22C 7/02; B22C 9/04; B22C 9/08; B22C 9/10; B22C 9/108; B22C 9/20; B22C 9/24; B22D 25/02
See application file for complete search history.

(56) References Cited

U.S. PATENT DOCUMENTS 4,246,954 A * 1/1981 Cohen ..... B22C 9/04 164/129
4,532,974 A * 8/1985 Mills ..... B22C 9/106 164/132
(Continued)

FOREIGN PATENT DOCUMENTS

EP 0 899 039 A2 3/1999

OTHER PUBLICATIONS

International Search Report dated Feb. 19, 2016 in PCT/FR2015/052735 filed Oct. 12, 2015.
(Continued)

*Primary Examiner* — Kevin E Yoon
(74) *Attorney, Agent, or Firm* — Oblon, McClelland, Maier & Neustadt, L.L.P.

(57) ABSTRACT

A stack molding pattern and a shell for manufacturing aircraft turbine engine blades via lost wax casting. The stack molding shell includes a plurality of shell blade elements, each intended for producing a blade, wire elements being arranged within the shell blade elements; and a metal feeder including a plurality of metal outlets, each one radially open towards one of the shell blade elements and connected with the second end portion of the element. The shell includes a
(Continued)

protective screen, associated with each second end portion and intended to protect a sensitive portion of the wire elements against the direct impact of a flow of metal from the feeder. The sensitive portion is located in the second end portion, downstream from the protective screen.

10 Claims, 9 Drawing Sheets

(51) Int. Cl.

| | |
|---|---|
| ***B22C 9/10*** | (2006.01) |
| ***B22C 9/20*** | (2006.01) |
| ***B22C 9/24*** | (2006.01) |
| ***B22D 25/02*** | (2006.01) |
| ***B22D 29/00*** | (2006.01) |
| ***F01D 5/18*** | (2006.01) |
| ***F04D 29/32*** | (2006.01) |
| ***F04D 29/58*** | (2006.01) |

(52) U.S. Cl.
CPC ..... *B22C 9/24* (2013.01); *B22D 25/02* (2013.01); *B22D 29/001* (2013.01); *F01D 5/187* (2013.01); *F04D 29/324* (2013.01); *F04D 29/582* (2013.01); *F05D 2220/323* (2013.01); *F05D 2230/211* (2013.01); *F05D 2300/10* (2013.01)

(56) References Cited

U.S. PATENT DOCUMENTS 4,552,197 A * 11/1985 Mills ..... B22C 9/04 164/137
6,029,736 A 2/2000 Naik et al.

OTHER PUBLICATIONS

French Search Report dated Jun. 22, 2015 in FR1459834 filed Oct. 14, 2014.

* cited by examiner

STACK MOLDING PATTERN AND IMPROVED SHELL FOR MANUFACTURING AIRCRAFT TURBINE ENGINE BLADE ELEMENTS VIA LOST WAX CASTING

TECHNICAL FIELD

The invention relates to the field of cluster manufacturing of aircraft turbomachine vane elements, by the lost wax moulding technique. Each vane element is preferentially an individual vane, such as a compressor or turbine impeller moving vane. Alternatively, this can be a sector comprising a plurality of blades, such as a sector of low pressure distributor.

The invention more particularly relates to the design of the cluster-shaped pattern and that of the shell intended to be formed about this pattern partially of wax, in which shell the metal is intended to be cast for obtaining turbomachine vane elements. It relates more specifically to the problem of breaking of the wire elements equipping the shell, these wire elements being intended to be surrounded by the metal upon casting, and then removed to give way to cooling channels passing through the vane element.

The invention relates to any type of aircraft turbomachine, in particular turbojet engines and turboprop engines.

STATE OF PRIOR ART

It is known from prior art to use the lost wax moulding technique to simultaneously manufacture several aircraft turbomachine vane elements, such as moving vanes. Such a technique is for example described in document FR 2 985 924.

As a reminder, the precision lost wax moulding consists in making with wax, by injecting into toolings, a pattern of each of the desired vane elements. The assembly of these patterns on a distributor of wax enables a cluster-shaped pattern to be made, which is then dipped into different substances in order to form around it a ceramic shell with a substantially uniform thickness. The cluster-shaped pattern is also known as "replica", "cluster-assembly" or even "wax tree", although not all its components are necessarily made of wax or in another sacrificial material.

The method is continued by melting wax, which then leaves its accurate fingerprint in the ceramic shell, in which the molten metal is poured, via a pouring bush assembled to the metal distributor. After cooling the metal, the shell is destroyed and the metal pieces are separated and completed.

This technique offers the advantage of dimensional accuracy, enabling some machinings to be reduced or even cancelled. Furthermore, it offers a very good surface aspect.

When the vane element to be manufactured has to include cooling channels, the shell is equipped with wire elements passing through the fingerprints. These wire elements are preferably made based on silica. Upon casting the metal into these fingerprints, the molten metal surrounds the wire elements, which are then removed to give way to cooling channels passing through the solidified vane element. In use, the cooling air can flow from the root to the head of the vane element, to ensure cooling thereof.

The wire elements of silica, also called glass tubes, thus travel through the fingerprints of the shell, substantially along the span direction of the vane elements. A so-called sensitive portion of these wire elements is radially facing the outlet of the metal distributor. This portion is actually said to be sensitive, because it tends out to be susceptible to breaking risks due to the impact of the metal flow exiting the distributor. If such a breaking of one or more of the wire elements occurs following the impact of the metal flow, the piece is supposed to be defective, and then discarded.

In an attempt to solve this problem, document EP 0 899 039 suggests to strengthen quartz tubes by a carbon fibre inserted inside the tube. However, this technique remains expensive, and cannot turn out to be fully satisfactory.

Thus, there is a need for optimising the current technique, to reduce the breaking risks of the glass wire elements.

DISCLOSURE OF THE INVENTION

The purpose of the present invention is thus to at least partially overcome the above-mentioned drawbacks, relative to embodiments of prior art.

For this, one object of the invention is first a cluster-shaped pattern, about which a shell is intended to be formed for manufacturing a plurality of vane elements of an aircraft turbomachine via lost wax moulding, said pattern comprising:

- a plurality of wax replicas each corresponding to one of said turbomachine vane elements, each replica comprising a blade part located between a first end and a second end, and through which wire elements for subsequently forming cooling channels through the vane element pass, the wire elements successively passing through the first end part, the blade part and the second end part;
- a metal feeding portion, having a centre axis about which the wax replicas are distributed;
- a connecting zone between the metal feed portion and the second end part of each wax replica.

According to the invention, the cluster-shaped pattern includes at each connecting zone a protective screen aiming at protecting, during a step of casting metal into the shell, a sensitive portion of said wire elements against the direct impact of a metal flow, said sensitive portion being located in the second end part, radially outwardly with respect to the protective screen, along said centre axis.

Analogously, one object of the invention is a shell for manufacturing a plurality of vane elements of an aircraft turbomachine via lost wax moulding, said cluster-shaped shell comprising:

- a plurality of shell vane elements each for obtaining one of said turbomachine vane elements, each shell vane element comprising a blade part located between a first end part and a second end part, each shell vane element defining a cavity within which wire elements are arranged, about which metal is intended to be cast, the wire elements passing successively through the first end part, the blade part and the second end part;
- a metal feeder having a centre axis about which said shell vane elements are distributed, said metal feeder comprising a plurality of metal outlets each radially open with respect to the centre axis towards one of the shell vane elements and communicating with the second end part of this shell vane element.

According to the invention, the shell includes, being associated with each second end part, a protective screen aiming at protecting a sensitive portion of said wire elements against the direct impact of a metal flow from the feeder, said sensitive portion being located in the second end part, downstream of the protective screen. Of course, the term downstream is here to be considered with regard to a primary metal flow direction, within the relevant pieces of the shell. In other words, upon casting, the metal first meets the protective screen before meeting the sensitive portion of the wire elements that this screen aims at protecting.

The invention is remarkable in that it makes it possible, in a clever and cheap way, to strongly limit the breaking risks of the wire elements during the subsequent metal casting within the shell. Indeed, the protective screens have the function to deviate the metal flow such that it does not directly impact any longer the sensitive portion of the wire elements. By virtue of this flow deviation, the metal can bypass the sensitive part before contacting the same, which dramatically reduces heat and mechanical impacts onto the wire elements.

In other words, by virtue of the invention, the wire elements are not directly impacted by the metal flow at their surface radially oriented facing the distributor outlet, but impacted at their opposite surface.

The invention has at least one of the following optional characteristics, taken alone or in combination. Furthermore, it is noted that if the below-mentioned characteristics are described in relation with the shell, it should be understood that they are analogously applicable to the cluster-shaped pattern, about which this shell is intended to be formed.

Said protective screen is arranged at said metal outlet of the distributor by axially extending through the entirety of this metal outlet, so as to force the metal flow to circulate on one side and/or on the other side of the screen.

The protective screen is arranged radially facing said sensitive portion of said wire elements.

The protective screen has a rectangular parallelepiped shape. However, many other shapes can be suitable, for example cylindrical, spherical, elliptic, ovoid, etc. The rectangular parallelepiped shape has however been retained for the high-performance results observed during tests on the shell in accordance with the invention.

The protective screen is made from a ceramic element equipping a cluster-shaped pattern about which the shell is intended to be formed, or made upon forming this shell by filling a dedicated fingerprint in said cluster-shaped pattern, partially of wax.

The shell is made of ceramics, preferably by dipping.

Said wire elements are made based on silica, preferably as tubes.

Said shell vane elements are each designed for obtaining a single moving vane, such as a compressor or turbine impeller moving vane.

Another object of the invention is a method for manufacturing such a shell, comprising making a cluster-shaped pattern about which the shell is intended to be formed, said pattern being equipped with ceramic pieces for forming said protective screens, or equipped with fingerprints in which the shell is intended to be formed to make up said protective screens. In this regard, the shell is preferentially obtained by dipping the cluster-shaped pattern into several ceramic baths.

Finally, another object of the invention is a method for manufacturing a plurality of vane elements of an aircraft turbomachine via lost wax moulding, implemented using such a shell and/or such a cluster-shaped pattern, the method comprising a step of casting metal into the shell, during which each protective screen deviates the molten metal such that this metal bypasses the sensitive part of the wire elements before contacting the same. As discussed above, by virtue of this technique unique to the invention, the wire elements are thus not directly impacted by the metal flow at their surface radially oriented facing the distributor outlet, but impacted at their opposite surface.

Preferably, the method comprises the following successive steps of:

making the shell;

casting metal into the shell;

extracting the vane elements obtained in the shell vane elements; and removing the wire elements, so as to reveal cooling channels through the vane elements.

Further advantages and characteristics of the invention will appear in the non-limiting detailed description below.

BRIEF DESCRIPTION OF THE DRAWINGS

This description will be made with regard to the appended drawings in which.

DETAILED DISCLOSURE OF PREFERRED EMBODIMENTS

Figure 1:
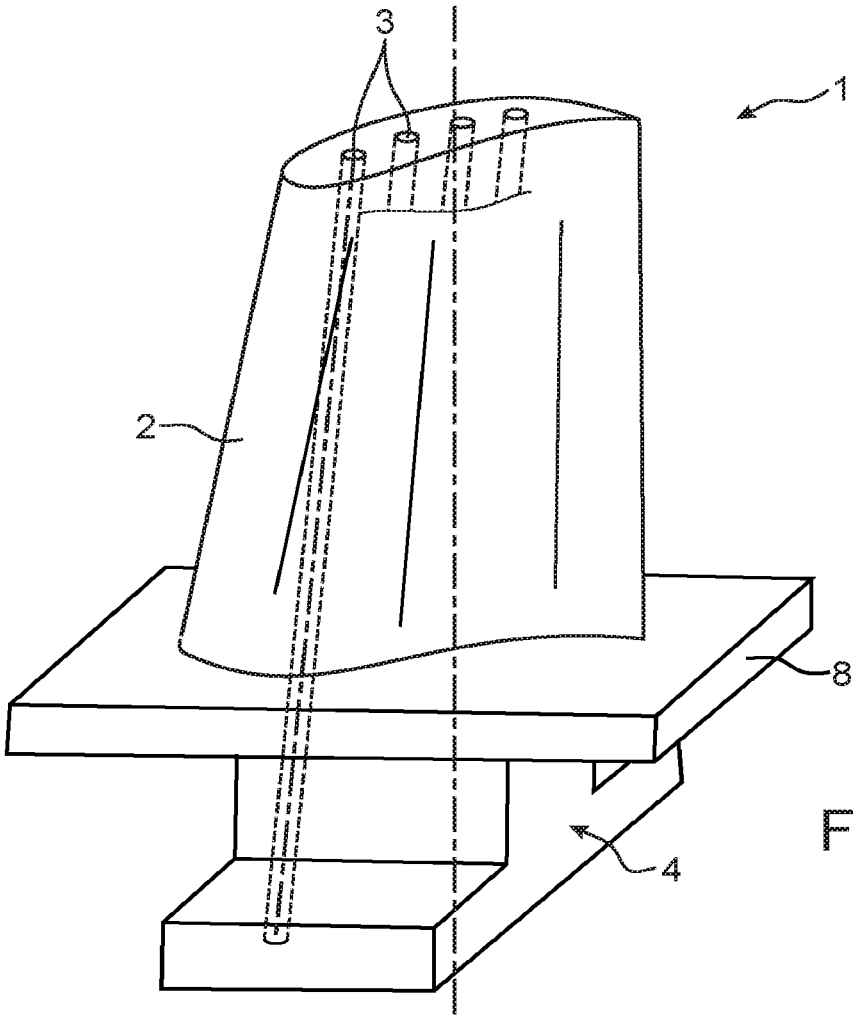
FIG. 1 represents a perspective view of a turbomachine vane element intended to be obtained by the implementation of the method according to the present invention, said vane element having the form of a high pressure turbine moving vane.

In reference to FIG. 1, an exemplary high pressure turbine moving vane 1 for an aircraft turbomachine is represented. Conventionally, this vane 1 comprises a blade 2 extending from an end 4 forming a vane root, and comprising a platform 8 for delimiting a primary gas flow path.

The vane 1 includes cooling airway channels 3. These cooling channels 3 fully pass through the vane, along the span direction of the vane. Thus, each channel 3 opens into the head or top of the vane, as well as at the root 4 thereof.

It is noted that in the following of the description, the terms "top", "bottom", "above" and "below" are intended according to the orientation of the views in the figures.

The invention aims at manufacturing the moving vane 1 from a shell intended to be made by a method specific to the invention, a preferred embodiment of which will now be described in reference to FIGS. 2 to 10. However, it is noted that the invention can also be applied to the manufacture of compressor moving vanes, or to the manufacture of compressor or turbine stator vanes, made alone or by sectors comprising several vanes.

For manufacturing the shell, a cluster-shaped pattern is first made, about which a ceramic shell is intended to be subsequently formed. The pattern 100 is essentially comprised of sacrificial elements made of wax, but not exclusively. However, in the following, it will be called "wax pattern".

Figure 2:
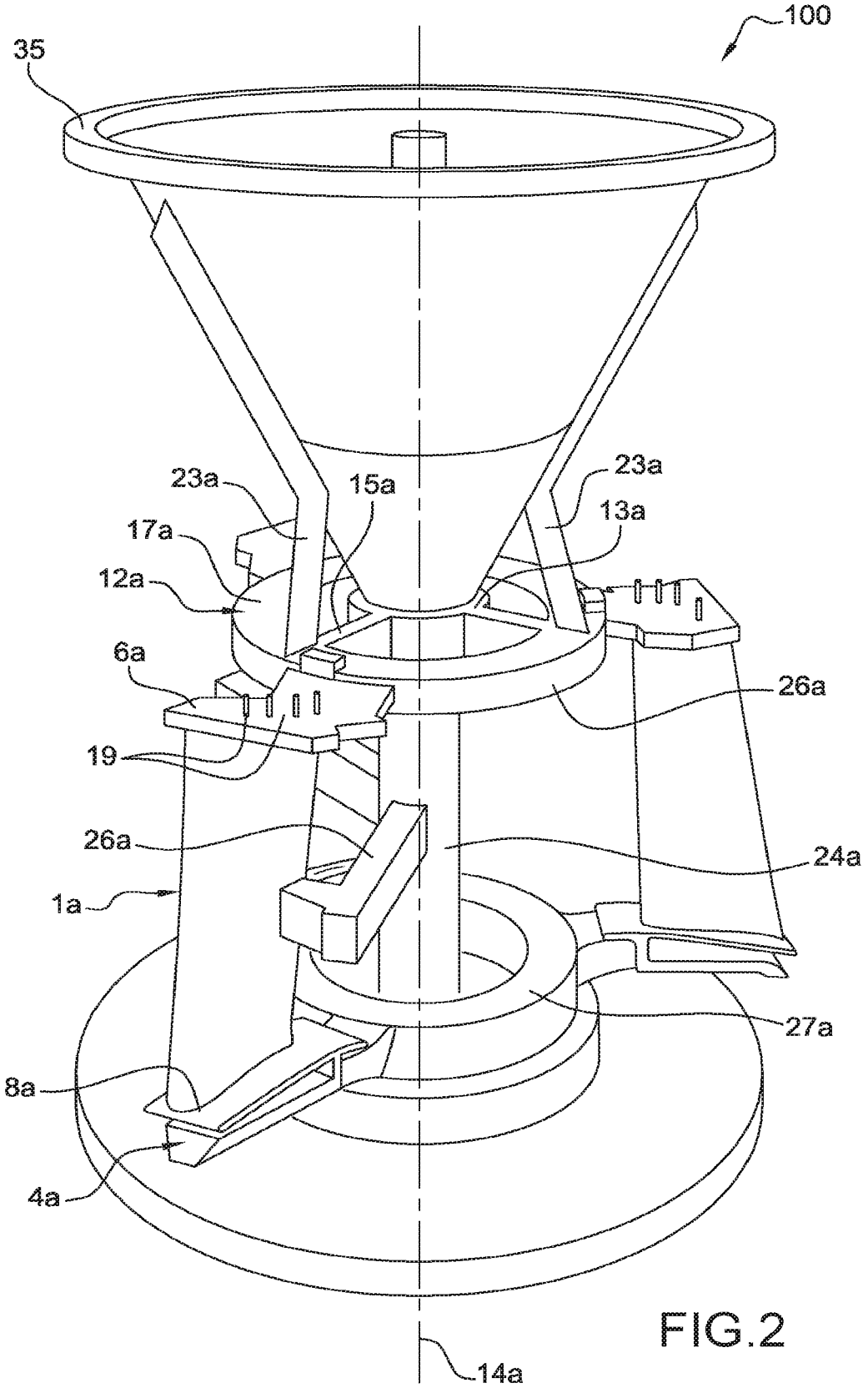
FIG. 2 represents a perspective view of a cluster-shaped pattern for manufacturing a shell for making, via lost wax moulding, vanes of the type shown in FIG. 1.
Figure 3:
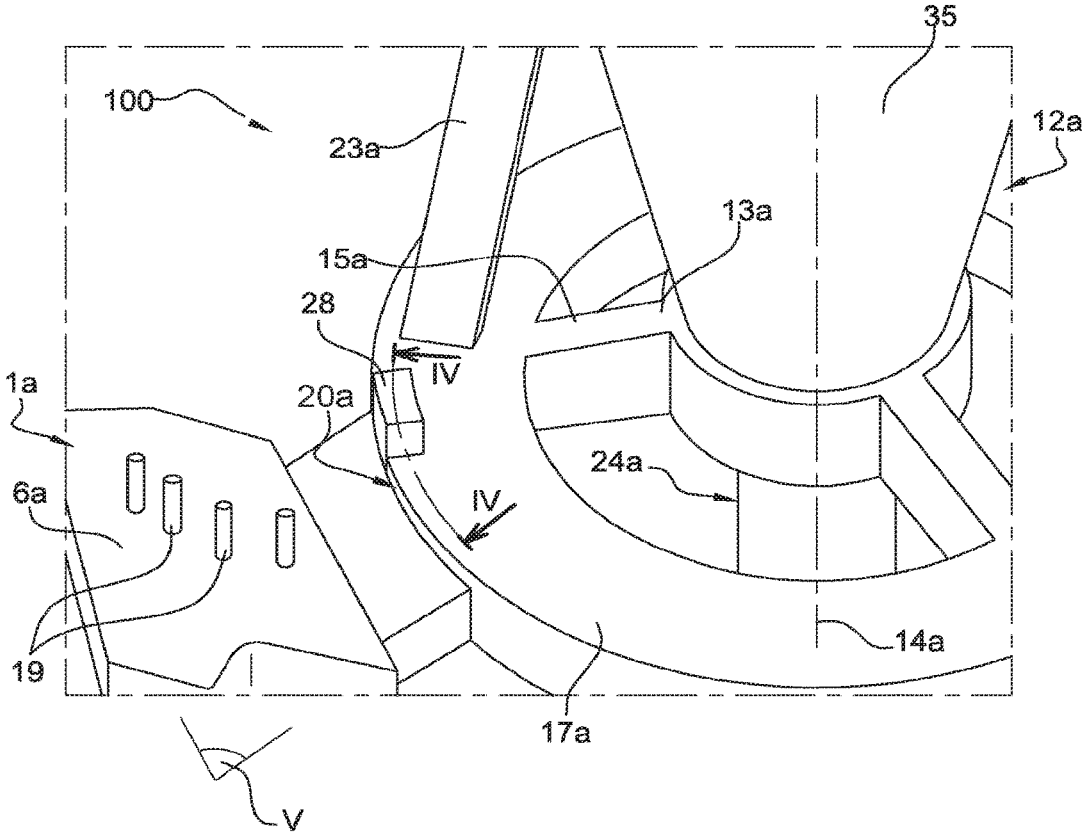
FIG. 3 represents an enlarged partial view of FIG. 2.

In FIG. 2, the wax pattern 100 is represented in a position in which the shell is then filled with metal. However, making the wax pattern in a position upside-down with respect to that shown in FIG. 2 facilitates the assembly operation of the different elements making up this wax pattern, which will now be described.

The pattern 100 first includes a portion for distributing metal, referenced 12*a*. This wax portion comprises a solid centre element 13*a* having a revolutionary, cylindrical or conical shape, with a centre axis 14*a* coincident with the centre axis of the entire wax pattern 100. The axis 14*a* is vertically oriented, and thus considered as representing the height direction.

The solid centre element 13*a* is attached to metal pouring bush 35 with a conical shape, located above this solid element 13*a*. The same is connected by radial arms 15*a* to a distribution crown 17*a* centred on the axis 14*a*. The arms 15*a* and the crown 17*a* are arranged just below the pouring bush 35.

To enhance holding of the crown 17*a* of the distribution portion 12*a*, several wax/ceramic holding reinforcements 23*a* connecting the crown 17*a* to the bush 35 are provided. These reinforcements 23*a* are substantially vertically oriented in the position of the pattern 100 depicted in FIG. 2.

Furthermore, at the periphery of the distribution crown 17*a*, wax replicas 1*a* of the turbine vane represented in FIG. 1 are attached.

Each replica 1*a* thus comprises a blade 2*a*, arranged between a first end 4*a* and a second end 6*a* to which the blade is connected. The first end 4*a* forms a vane root, and comprises a platform 8*a*. The second end 6*a* is in turn arranged above the blade head, at the distribution crown 17*a* along the height direction. The second end 6*a* has an enlarged shape with respect to the blade 2*a*, as has been schematically represented in FIG. 2.

The direction along which the blade 2*a* and the ends 4*a*, 6*a* follow each other corresponds to the radial direction or span direction of the wax vane element 1*a*, this direction being preferably substantially parallel to the direction of the axis 14*a*, that is parallel to the height direction of the replica 100.

Wire elements 19 of glass, intended to form subsequently the above-mentioned cooling channels 3, represented in FIG. 1, pass through the wax vanes 1*a*. They entirely pass through each vane 1*a*, by successively passing through the first end 4*a*, the blade part 2*a*, and the second end part 6*a* connected to the distribution crown 17*a*. As is visible in FIG. 2, the wire elements 19, preferably as silica based glass tubes, project from either side of each vane 1*a*, along the span direction.

The wax vanes 1*a* thus extend upwardly, by being provided about the axis 14*a*, and also about a wax centre support 24*a* extending along the same axis, downwardly from the centre element 13*a* of the distribution portion 12*a*. The support 24*a* has preferentially the shape of a cylinder with the axis 14*a*, which extends up to the vicinity of the end 4*a* of the wax vane 1*a*.

Intermediate wax radial arms 26*a* connect the support 24*a* to the blades 2*a*, at mid-height of the same.

Finally, the low end of the support 24*a* is connected to the ends 4*a* of the wax vanes 1*a*, via a secondary distribution crown 27*a*, similar to the above-mentioned crown 17*a*.

The wax vanes 1*a* form the peripheral wall of the wax replica 100, with the axis 14*a*. They are circumferentially spaced from each other, and define an internal space centred on this axis 14*a*, in which space the above-mentioned support 24*a* is thus located.

It is noted that if the replicas 1*a* have been represented with the vane root 4*a* arranged in the bottom with respect to the blade 2*a* in the position of FIG. 2, this root 4*a* could alternatively be arranged at the top, without departing from the scope of the invention.

In reference now more specifically to FIGS. 3 to 6, upon making the wax replica 100, ceramic protective screens 28 are assembled thereto. These screens 28 are arranged in the periphery of the distribution crown 17*a*, at a connecting zone 30*a* between the crown 17*a* and each second end part 6*a*. As will be detailed hereinafter, these screens 28 have the function to deviate the metal flow subsequently cast into the shell, such that it does not directly impact any longer the sensitive portion of the wire elements. By virtue of this flow deviation, the metal can bypass the sensitive part before contacting the same, which reduces heat and mechanical impacts onto the glass wire elements.

Each protective screen 28 has a substantially rectangular parallelepiped shape, or that of an angular sector of a revolutionary piece, with an axis 14*a*. Its major axis is preferably substantially oriented in parallel to the axis 14*a*. The screen 28 is housed in a depression of the periphery of the crown 17*a*, such that its radially outwardly oriented surface is substantially in the geometric continuity of the peripheral rim of this crown, as visible in FIGS. 3 and 5. However, the screen 28 could be arranged more outwardly in the radial direction, for example so as to pass through the connecting zone 30*a*, without departing from the scope of the invention.

Figure 5:
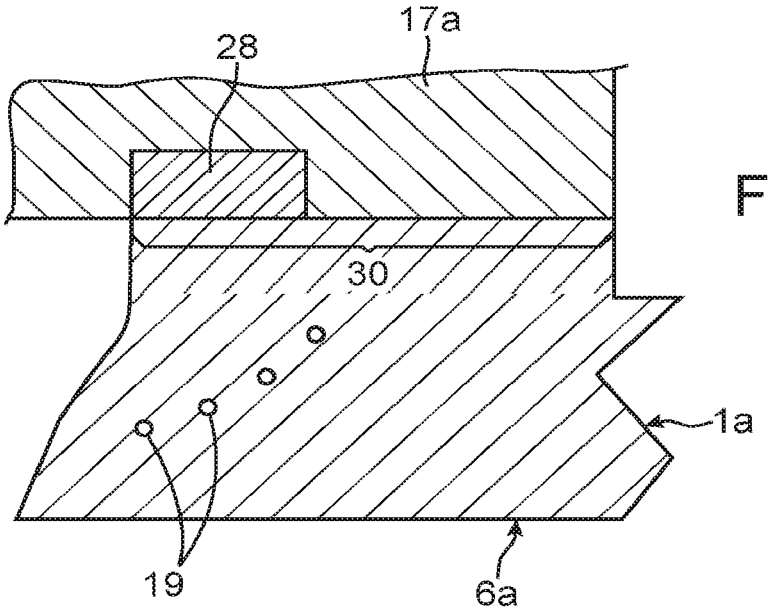
FIG. 5 represents a cross-section view taken along plane V-V of FIG. 3.

In FIG. 5, it is also possible to see the screen 28 radially facing glass wire elements 19, intended to be protected from the metal flow by this screen. Moreover, the wire elements 19 are radially outwardly arranged with respect to the screen 28, along the centre axis 14*a*.

Figure 4:
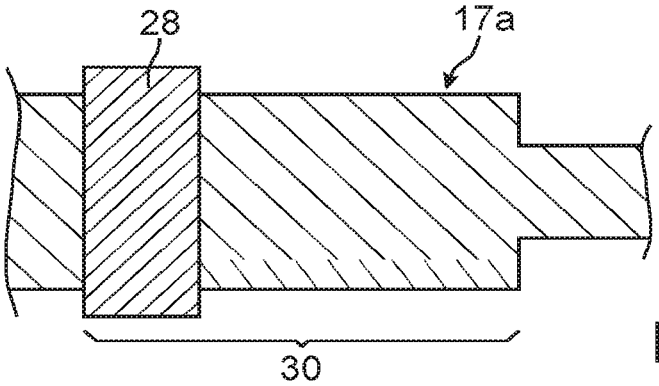
FIG. 4 represents a cross-section view taken along line IV-IV of FIG. 3.
Figure 6:
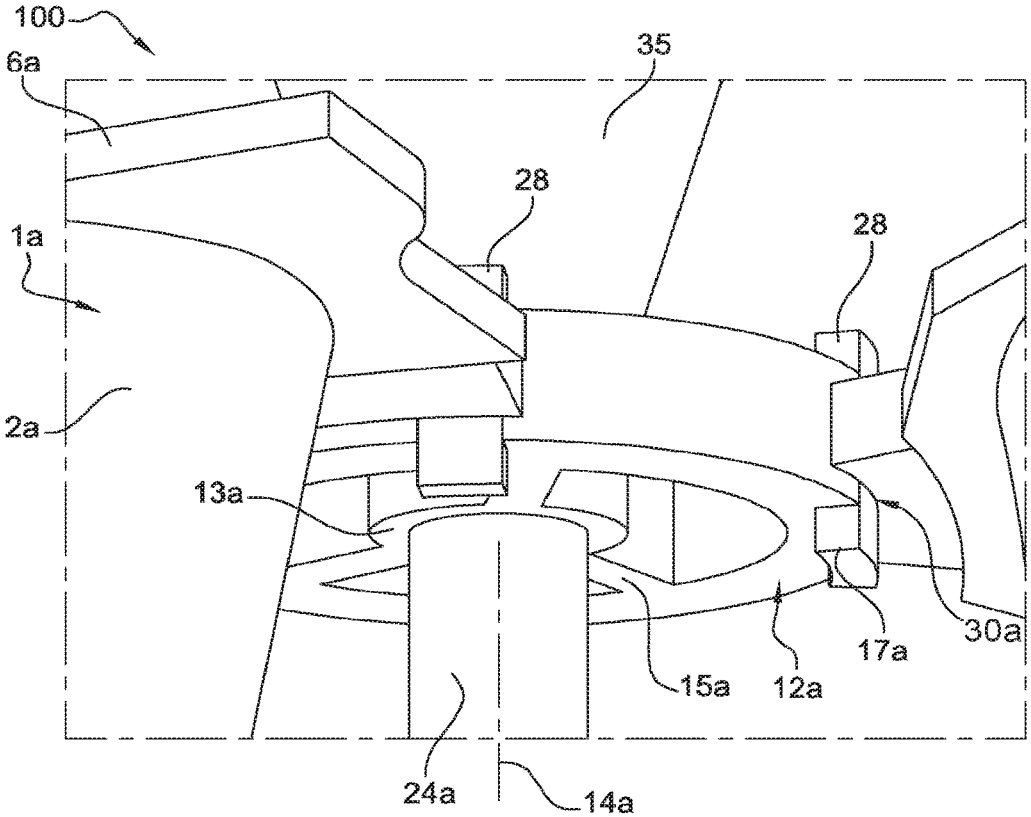
FIG. 6 is a perspective view similar to that of FIG. 3, at a different angle of view.

Furthermore, the protective screen 28 extends vertically beyond the distribution crown 17*a*, on either side of the same, as is best visible in FIGS. 4 and 6. By virtue of this arrangement, when the wax distribution crown 17*a* is removed and that it gives way, at the junction zone 30*a*, to a metal outlet (the future location of which is identified by the reference 30 in FIGS. 4 and 5), the metal flow is forced to flow on one side of the screen, that is to circumferentially bypass the same.

Figure 5A:
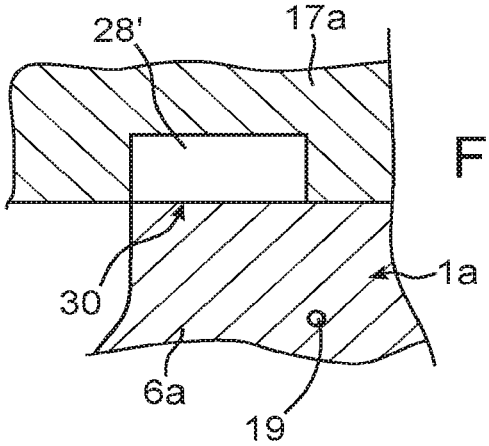
FIG. 5*a* is a view similar to that of FIG. 5, with the cluster-shaped pattern represented according to an alternative embodiment.

As will be described hereinafter, the shell is intended to be formed about the wire pattern 100, and thus about the screens 28 which will remain integrated to this shell upon casting metal, and which thus will not be removed with the rest of the pattern 100 before this cast. However, in the alternative embodiment represented in FIG. 5*a*, the ceramic protective screens are replaced by finger prints 28' of any shape, intended to be filled by the materials making up the shell upon forming the same. Consequently, in this alternative embodiment, the protective screens are formed at the same time as the shell, and form a single piece.

After obtaining the wax pattern 100 described in FIGS. 2 to 6, the shell is manufactured about this pattern. The implementation of the step of making the ceramic shell is made by dipping the pattern 100 in successive baths (not represented). This step is known per se, and thus will not be further described.

After being dried, the shell 200 which is obtained is schematically represented in FIGS. 7 to 10. It also generally has a cluster shape, and of course includes similar elements to those of the wax replica 100. These shell elements will now be described, with the shell represented in a position as assumed afterwards when filled with metal.

The shell 200 first includes a metal distributor, referenced 12*b*. The distributor comprises a solid centre element 13*b* with a revolutionary, cylindrical or conical shape, with a centre axis 14*b* coincident with the centre axis of the shell 200, which is vertically oriented.

The solid centre element 13*b* is attached to the metal pouring bush 35, which can be entirely or partially covered with the shell. Radial arms 15*b* connect the solid centre element 13*b* to a distribution crown 17*b* centred on the axis 14*b*. The arms 15*b* and the crown 17*b* are arranged just below the pouring bush 35.

To enhance holding the crown 17*b*, several wax/ceramic holding reinforcements 23*b* connecting the crown 17*b* to the bush 35 are provided. These reinforcements 23*b* are substantially vertically oriented in the position of the shell 200 depicted in FIG. 7.

Moreover, in the periphery of the distribution crown 17*b*, shell vane elements 1*b* are attached. These elements 1*b* are so-called vane elements because after removing the wax replica 1*a*, they each form internally a cavity corresponding to one of the vanes 1.

Figure 7:
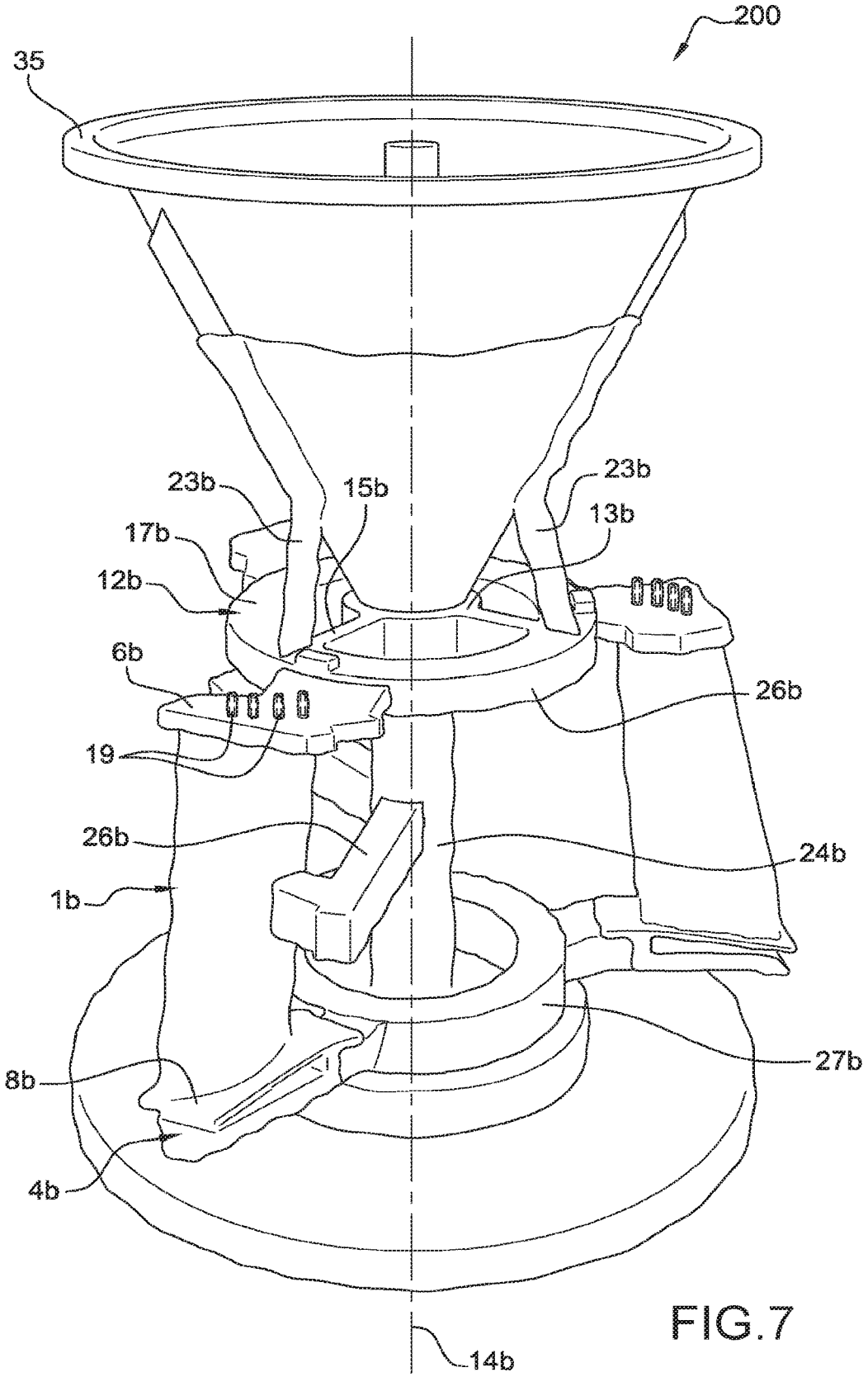
FIG. 7 represents a schematic view of a shell specific to the present invention, obtained using the cluster-shaped pattern shown in the preceding figures.
Figure 8:
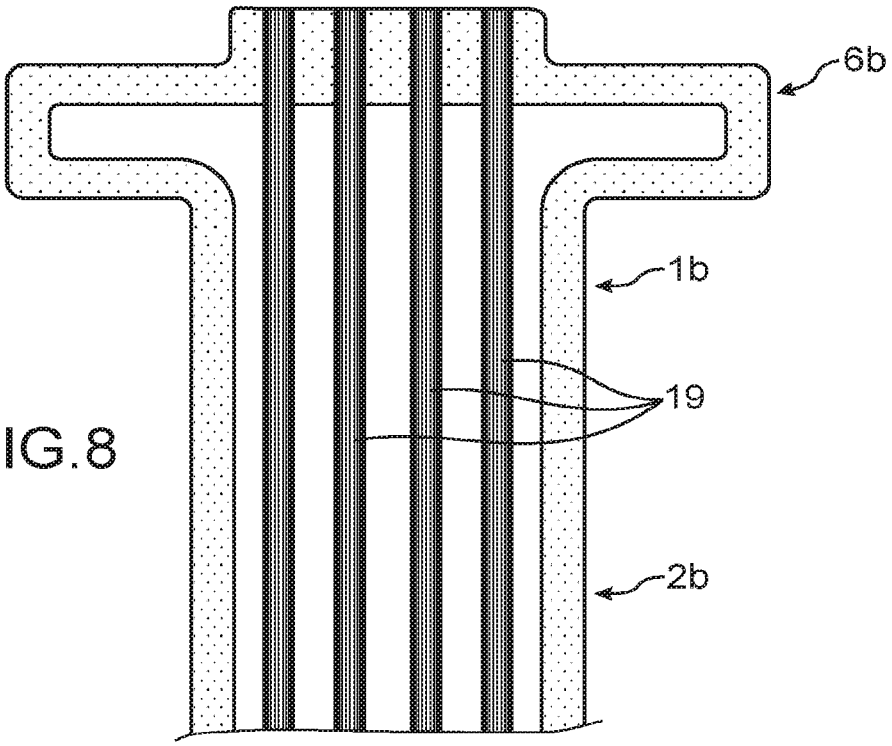
FIG. 8 represents a partial cross-section view of a shell vane element.

As is visible in the schematic FIGS. 7 and 8, each shell vane element 1*b* thus comprises a blade part 2*b*, arranged between a first end 4*b* and a second end 6*b* to which the blade is connected. The first end 4*b* forms a vane root, and comprises a platform 8*b*. The second end 6*b* is in turn arranged above the blade head, at the distribution crown 17*b* along the height direction. The second end 6*b* has an enlarged shape relative to the blade 2*b*, as has been schematically represented in FIG. 8.

The direction along which the blade part 2*b* and the ends 4*b*, 6*b* follow each other corresponds to the radial direction or span direction of the shell vane element 1*b*, this direction being preferably substantially parallel to the direction of the axis 14*b*, that is parallel to the height direction of the shell 200.

The glass wire elements 19, for subsequently forming the channels for cooling the vanes, pass through the cavities defined by the shell vanes 1*b*. They entirely pass through each element 1*b*, by successively passing through the first end part 4*b*, the blade part 2*b*, and the second end part 6*b* connected to the distribution crown 17*b*. As is visible in FIGS. 7 and 8, the high and low ends of the glass wire elements 19 are embedded in the shell 200, which ensures holding them within the different cavities they pass through.

The shell vane elements 1*b* thus extend upwardly, by being provided about the axis 14*b*, and also about a centre support 24*b* extending along the same axis, downwardly from the centre element 13*b*. The support 24*b* has preferentially the shape of a hollow cylinder with an axis 14*b*, which extends up to the vicinity of the end 4*b* of the vane elements 1*b*.

Intermediate radial arms 26*b* connect the support 24*b* to the blade parts 2*b*, at mid-height of the same.

Further, the low end of the support 24*b* is connected to the ends 4*b* of the vane elements 1*b*, via a secondary metal distribution crown 27*b*, similar to the afore-mentioned crown 17*b*.

The vane elements 1*b* form the peripheral wall of the shell 200, with the axis 14*b*. They are circumferentially spaced from each other, and define an internal space centred on this axis 14*b*, in which space the support 24*b* is thus located.

Figure 9:
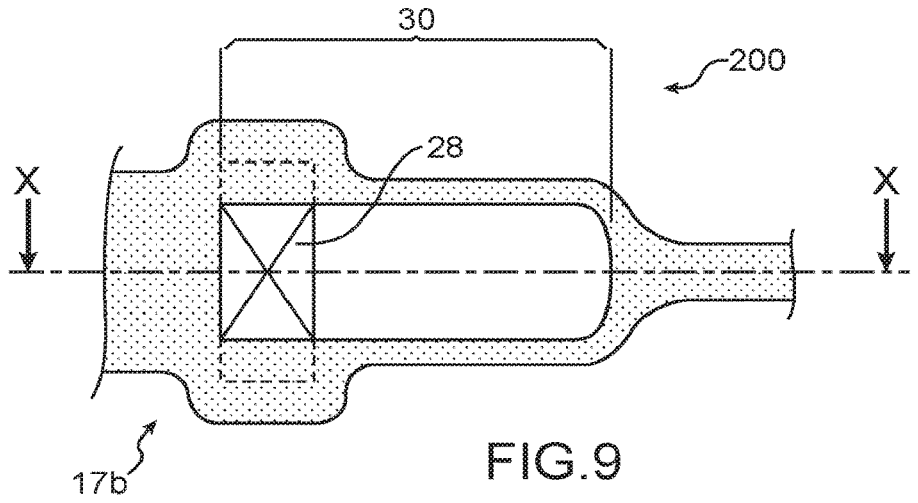
FIG. 9 shows a metal outlet provided on the distributor of the shell, and corresponds to a cross-section view taken along line IX-IX of FIG. 10.
Figure 10:
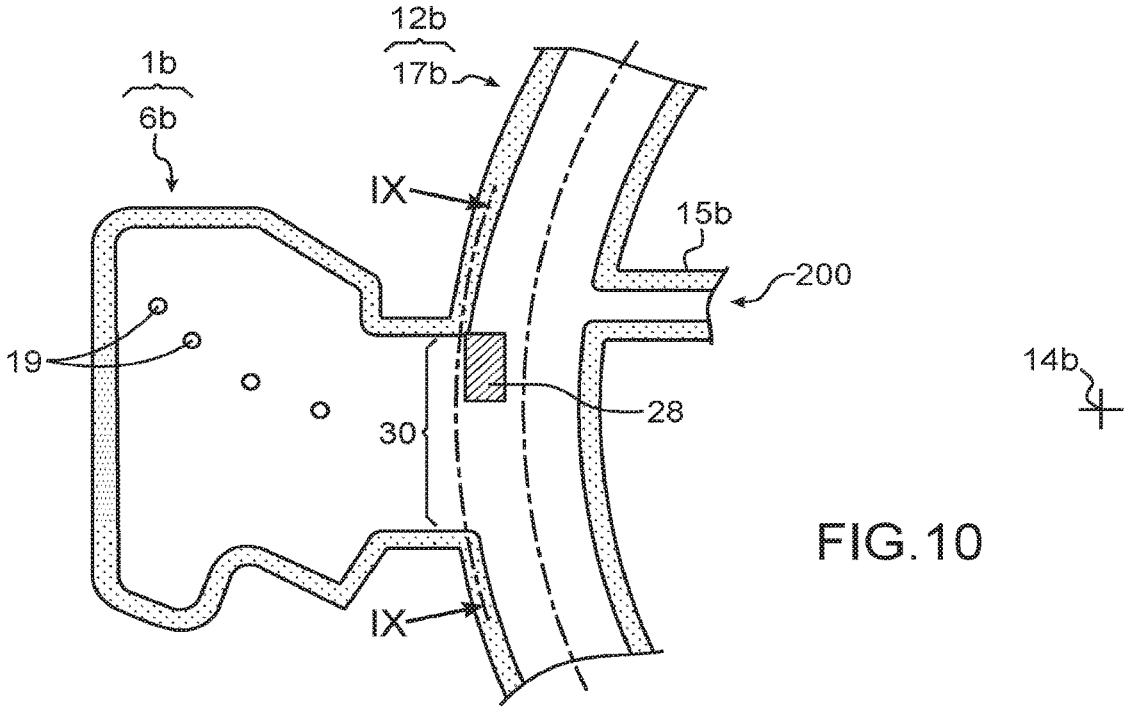
FIG. 10 is a cross-section view taken along line X-X of FIG. 9.

In reference now more specifically to FIGS. 9 and 10, the distributor 17*b* is shown with one of its metal outlet 30, corresponding to a radial aperture on the rim of this distributor, that is at the periphery thereof, where the connecting zone 30*a* on the wax pattern 100 was located. This metal outlets 30 is thus obtained by removing wax, which initially occupied this aperture, oriented radially outwardly towards the second end part 6*b*, with which it directly communicates.

The metal outlet 30 is equipped with the protective screen 28, sealing a circumferential end part of this outlet. The screen 28, arranged at the junction with the second end part 6*b*, is thus located upstream of the sensitive portion of the wire elements 19 housed in the cavity of this second end part 6*b*, the term upstream to be considered with regard to a primary metal flow direction within the relevant pieces.

It is also contemplated to be surrounded by the shell at its high and low ends, as is visible in FIG. 9. Embedding these ends into the shell 200 enables holding it within the same to be ensured. This also enables the screen to axially extend through the entirety of the metal outlet 30, that is on the entire height thereof. By axially extending in this way, the screen 28 forces the metal flow to flow on one side of this screen, in order to achieve the intended effect of flow deviation, for the afore-mentioned purposes.

Furthermore, the protective screen 28 is arranged radially facing the sensitive portion of the glass wire elements 19. The circumferential extent of the screen is not necessarily identical to that of the network of wire elements, but can be lower. This circumferential extent, as well as other parameters such as the position of the screen 28 within the metal outlet 30, can be adjusted such that during the subsequent cast, the metal flow is properly deviated and that it does not directly impact the sensitive portion of the wire elements 19. Consequently, depending on the shell geometry and the position of the wire elements 19, the screen 28 could be placed in a different location from that at one of the ends of the metal outlet 30, so as to force the metal to flow on either side of the same, in order to properly protect the sensitive part of these wire elements.

After obtaining the shell 200 and removing most of the pattern 100 enclosed in the same, the shell is preheated at a high temperature in a dedicated oven, for example at 1150° C., in order to promote metal fluidity in the shell during casting.

Following preheating the shell, metal exiting a melting oven is cast into the fingerprints via the bush 35, with the shell in the position as shown in FIG. 7, that is with the bush 35 open upwardly and always the axis 14*b* oriented vertically.

The molten metal thus successively travels the bush 35, the distributor 12*b*, and then the shell vane elements 1*b*, by simply flowing by gravity. The metal also flows downwardly inside the support 24*b*, to supply thereafter the intermediate radial arms 26*b* and the secondary distribution crown 27*b*. On the other hand, even if it is a less sensitive region, the second end parts 4*b* located in the bottom of the shell could be equipped with substantially identical screens for protecting the portion of the glass tubes 19 which is located radially facing the metal outlets of the secondary distributor 27*b*, without departing from the scope of the invention.

It is noted that the reinforcements 23*b* are preferentially solid, of ceramic, thus the molten metal upon casting in the shell 300 does not pass therethrough.

Figure 11:
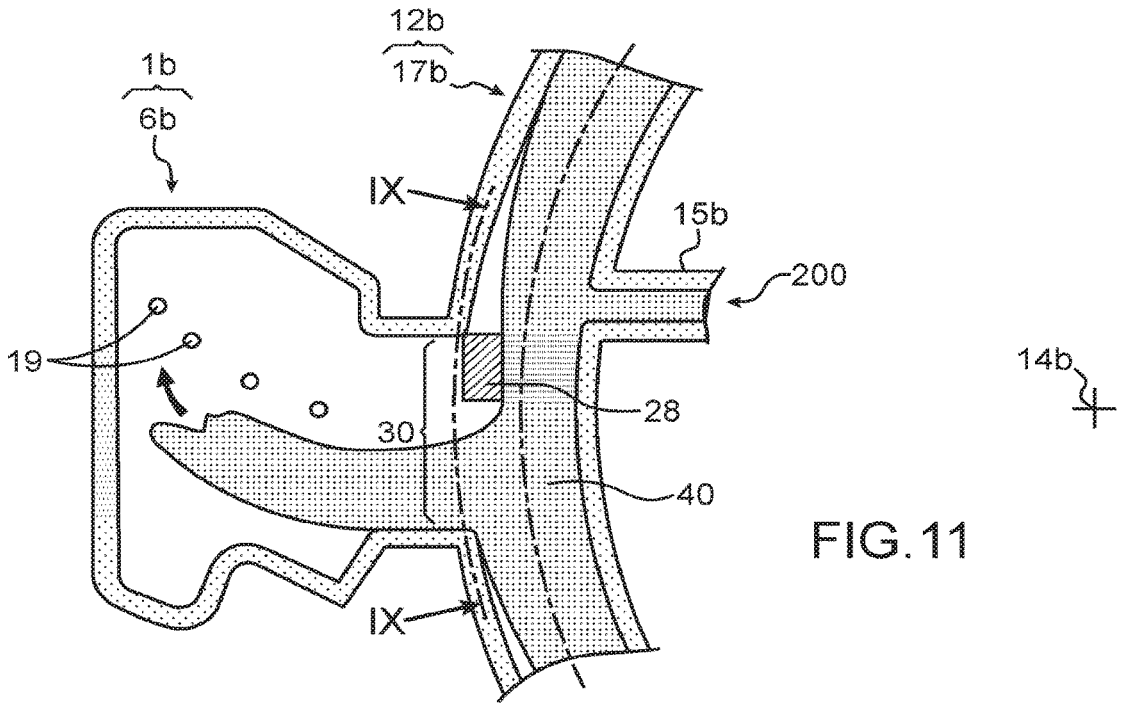
FIGS. 11 and 12 represent similar views to that of FIG. 10, with the shell depicted in different states at the start of a step of casting metal.

Upon initiating this cast, the metal flows through the solid centre element 13*b*, the radial arms 15*b*, and then circumferentially travels through the crown 17*b* up to arrive in the proximity of the metal outlet 30. As has been schematically represented in FIG. 11, the metal 40 arriving at the circumferential end of the outlet 30 cannot pass though this outlet, because it is sealed by the protective screen 28 which deviates the flow. The flow thus passes next to it, in the circumferential direction, of the protective screen 28, to then pass through the unsealed part of the metal outlet 30.

Figure 12:
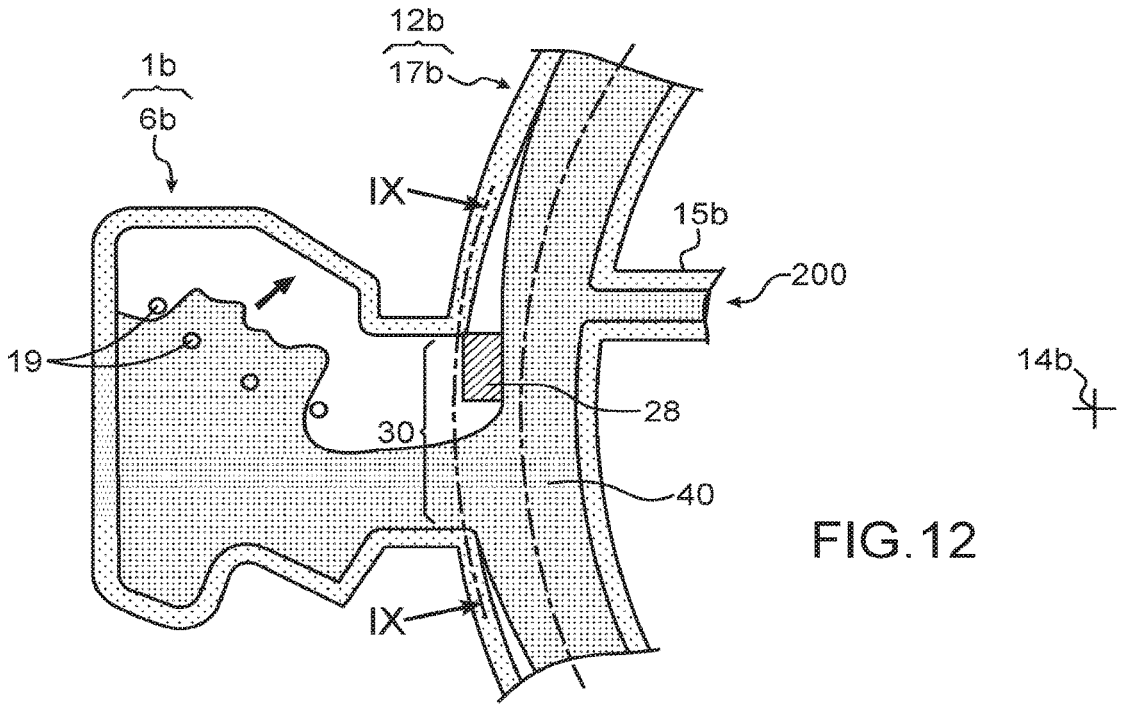

By virtue of this deviation and the velocity of the metal flow, the latter can bypass the sensitive part of the glass wire elements 19, before contacting these elements, which reduces heat and mechanical impacts on the glass wire elements. As has been depicted in FIG. 12, by virtue of the performed bypass, the sensitive part of the glass wire elements 19 is not directly impacted by the metal flow at their surface oriented radially inwardly facing the outlet 30, but impacted at their opposite surface, oriented radially outwardly.

After cooling the metal following the cast, the shell is destroyed, and then the moving vanes 1 are extracted from the cluster for possible machinings and finishing and check operations. Among these steps, there is that of removing the glass tubes 19 that are still present within the obtained vanes. This removing step is conventionally made, for example by chemical destruction.

Of course, various modifications can be made by those skilled in the art to the invention just described, only by way of non-limiting examples.

The invention claimed is:

1. A cluster-shaped pattern, about which a shell is to be formed for manufacturing a plurality of vane elements of an aircraft turbomachine via lost wax moulding, said pattern comprising:

a plurality of wax replicas each corresponding to one of said turbomachine vane elements, each replica comprising a blade part located between a first end and a second end, and through which wire elements for subsequently forming cooling channels through the vane element pass, the wire elements successively passing through the first end part, the blade part and the second end part;

a metal feeding portion, having a centre axis about which the wax replicas are distributed;

a connecting zone between the metal feed portion and the second end part of each wax replica;

wherein the cluster-shaped pattern includes at each connecting zone a protective screen aiming at protecting, during a step of casting metal into the shell, a sensitive portion of said wire elements against the direct impact of a metal flow, said sensitive portion being located in the second end part, radially outwardly with respect to the protective screen, along said centre axis.

2. A shell for manufacturing a plurality of vane elements of an aircraft turbomachine via lost wax moulding, said shell comprising:

a plurality of shell vane elements each for obtaining one of said turbomachine vane elements, each shell vane element comprising a blade part located between a first end part and a second end part, each shell vane element defining a cavity within which wire elements are arranged, about which metal is intended to be cast, the wire elements passing successively through the first end part, the blade part and the second end part;

a metal feeder having a centre axis about which said shell vane elements are distributed, said metal feeder comprising a plurality of metal outlets each radially open with respect to the centre axis towards one of the shell vane elements and communicating with the second end part of this shell vane element;

wherein the shell comprises, being associated with each second end part, a protective screen aiming at protecting a sensitive portion of said wire elements against the direct impact of a metal flow from the feeder, said sensitive portion being located in the second end part, downstream of the protective screen.

3. The shell according to claim 2, wherein said protective screen is arranged at said metal outlet of the feeder by axially extending through the entirety of this metal outlet, so as to force the metal flow to circulate on one side and/or on the other side of the screen, and/or in that the protective screen is radially arranged facing said sensitive portion of said wire elements, said protective screen having preferably a rectangular parallelepiped shape.

4. The shell according to claim 2, wherein the protective screen is made from a ceramic element equipping a cluster-shaped pattern about which the shell is intended to be formed, or made upon forming this shell by filling a dedicated fingerprint into said cluster-shaped pattern.

5. The shell according to claim 2, made of ceramics.

6. The shell according to claim 2, wherein said wire elements are made based on silica.

7. The shell according to claim 2, said shell vane elements are each designed for obtaining a single moving vane.

8. A method for manufacturing a shell according to claim 2, comprising making a cluster-shaped pattern about which the shell is intended to be formed, said pattern being equipped with ceramic pieces for forming said protective screens.

9. A method for manufacturing a plurality of vane elements of an aircraft turbomachine via lost wax moulding, wherein said method is implemented with a shell according to claim 2, and/or using a cluster-shaped pattern, the method comprising a step of casting metal into the shell, during which each protective screen deviates the molten metal such that this metal bypasses the sensitive part of the wire elements before contacting the same.

10. The method according to claim 9, comprises the following successive steps of:

making the shell;

casting metal into the shell;

extracting the vane elements obtained in the shell vane elements; and removing the wire elements, so as to reveal cooling channels through the vane elements.

* * * * *